US011035620B1

(12) United States Patent
Trent et al.

(10) Patent No.: US 11,035,620 B1
(45) Date of Patent: Jun. 15, 2021

(54) LOOP HEAT PIPE TRANSFER SYSTEM WITH MANIFOLD

(71) Applicants: Richard W. Trent, John's Island, SC (US); Darrell R. Sandlin, Alpharetta, GA (US)

(72) Inventors: Richard W. Trent, John's Island, SC (US); Darrell R. Sandlin, Alpharetta, GA (US)

( * ) Notice: Subject to any disclaimer, the term of this patent is extended or adjusted under 35 U.S.C. 154(b) by 0 days.

(21) Appl. No.: 16/953,116

(22) Filed: Nov. 19, 2020

(51) Int. Cl.
*F28D 15/00* (2006.01)
*F28D 15/02* (2006.01)
*F24F 3/14* (2006.01)

(52) U.S. Cl.
CPC ..... *F28D 15/0266* (2013.01); *F28D 15/0275* (2013.01); *F24F 2003/144* (2013.01)

(58) Field of Classification Search
CPC .. F28D 15/0266; F28D 15/0275; F28D 15/06; F28D 1/05333; F28D 1/05308; F24F 2003/144
See application file for complete search history.

(56) References Cited

U.S. PATENT DOCUMENTS 1,597,733 A * 8/1926 Soule ..... F28D 1/05333 165/149
1,924,998 A * 8/1933 McGrail ..... F28D 1/05308 165/57
2,930,590 A * 3/1960 Sartori ..... F28D 1/05308 165/151
3,252,309 A * 5/1966 Maestrelli ..... F28D 1/05333 68/20
4,142,575 A * 3/1979 Glancy ..... F24F 12/002 165/66
4,180,127 A * 12/1979 Maxson ..... F28D 15/0275 165/104.21
4,434,843 A * 3/1984 Alford ..... F25B 39/00 165/150
5,309,725 A * 5/1994 Cayce ..... F24F 3/1405 62/90
5,333,470 A * 8/1994 Dinh ..... F24F 3/153 62/333
5,404,938 A * 4/1995 Dinh ..... F24F 3/1405 165/113
5,695,004 A * 12/1997 Beckwith ..... F24F 3/153 165/104.14
5,826,649 A * 10/1998 Chapp ..... F28F 9/0212 165/174
5,845,702 A * 12/1998 Dinh ..... F28D 15/0266 165/104.21
5,921,315 A * 7/1999 Dinh ..... F28D 15/0275 165/104.21
6,109,044 A * 8/2000 Porter ..... F28D 15/0266 165/104.21

(Continued)

*Primary Examiner* — Travis C Ruby
(74) *Attorney, Agent, or Firm* — Edward P. Dutkiewicz

(57) ABSTRACT

At least one manifold having a rounded closed end, an outlet tube, and a plurality of inlet openings which has heat transfer fins, with pipes running through pipe holes in the fins. The at least one manifold is coupled to a refrigerant carrying pipe. The manifold, fins, and conductive pipes form an evaporating unit and a condensing unit, which are located in an air duct having an airflow there through. There is a quantity of refrigerant being contained with the heat pipe transfer system.

8 Claims, 10 Drawing Sheets

(56) References Cited

U.S. PATENT DOCUMENTS 6,119,767 A * 9/2000 Kadota ..... F28D 15/0233 165/104.33
6,382,308 B2 * 5/2002 Okamoto ..... F25B 23/006 165/104.21
6,578,629 B1 * 6/2003 Trent ..... F28D 15/0266 165/274
6,591,902 B1 * 7/2003 Trent ..... F24F 1/0059 165/104.14
6,820,420 B2 * 11/2004 Hebert ..... F24S 10/95 60/641.7
6,883,596 B2 * 4/2005 Kim ..... F25B 39/04 159/13.3
6,918,435 B2 * 7/2005 Dwyer ..... F28D 1/05333 165/171
7,234,335 B2 * 6/2007 Lolli ..... F28D 1/05308 165/153
8,033,322 B1 * 10/2011 Trent ..... F24F 12/002 165/54
8,220,277 B2 * 7/2012 Dieckmann ..... F24F 1/02 62/93
9,032,743 B2 * 5/2015 Agostini ..... F28D 15/0233 62/119
9,113,578 B2 * 8/2015 Cottet ..... F28D 15/0266
9,113,579 B2 * 8/2015 Cottet ..... H05K 7/20672
10,168,084 B2 * 1/2019 Ota ..... F28F 9/0265
2001/0042614 A1 * 11/2001 Okamoto ..... F28D 15/0266 165/104.21
2004/0007349 A1 * 1/2004 Youn ..... F28F 1/022 165/115
2004/0069461 A1 * 4/2004 Yuyama ..... H01L 23/427 165/104.26
2004/0108105 A1 * 6/2004 Dwyer ..... F28F 9/167 165/181
2006/0185825 A1 * 8/2006 Chen ..... F28D 15/0266 165/104.21
2007/0163754 A1 * 7/2007 Dionne ..... F28D 15/06 165/104.21
2007/0169921 A1 * 7/2007 Abrahamian ..... F28F 1/325 165/151
2007/0175613 A1 * 8/2007 Li ..... H01L 23/427 165/104.21
2007/0175614 A1 * 8/2007 Li ..... F28D 15/043 165/104.26
2008/0247137 A1 * 10/2008 Dautert ..... F28D 15/0266 361/703
2009/0084129 A1 * 4/2009 Kim ..... F25B 39/00 62/502
2009/0266518 A1 * 10/2009 Huang ..... H01L 23/3672 165/104.19
2010/0071880 A1 * 3/2010 Kim ..... F28D 15/0266 165/104.26
2011/0271696 A1 * 11/2011 Hedberg ..... F28D 15/0266 62/64
2012/0186787 A1 * 7/2012 Dinh ..... F28D 15/06 165/104.26
2012/0291990 A1 * 11/2012 Lin ..... F28D 15/0266 165/67
2013/0104592 A1 * 5/2013 Cottet ..... F28D 15/0266 62/419
2013/0291564 A1 * 11/2013 Ghoshal ..... F28F 1/325 62/3.6
2014/0116653 A1 * 5/2014 Lange ..... F28D 15/0275 165/104.21
2015/0034270 A1 * 2/2015 Kim ..... F28D 15/0266 165/11.1
2015/0096721 A1 * 4/2015 Mochizuki ..... F28D 15/06 165/104.24
2015/0296665 A1 * 10/2015 Cacho Alonso .... F28D 15/0275 165/104.27
2016/0007502 A1 * 1/2016 Hayashi ..... F28D 15/0266 165/172
2016/0014933 A1 * 1/2016 Matsunaga ..... B23P 19/00 361/679.53
2016/0076819 A1 * 3/2016 Espersen ..... F28D 15/0266 165/104.21
2016/0169586 A1 * 6/2016 Ito ..... F28D 1/05391 165/104.21
2017/0328615 A1 * 11/2017 Morimoto ..... F25B 5/04
2019/0003776 A1 * 1/2019 Matsunaga ..... F28D 15/025
2019/0049185 A1 * 2/2019 Ito ..... F28F 17/005
2019/0316803 A1 * 10/2019 D'Arcy ..... F24F 12/002

* cited by examiner

FIG. 3
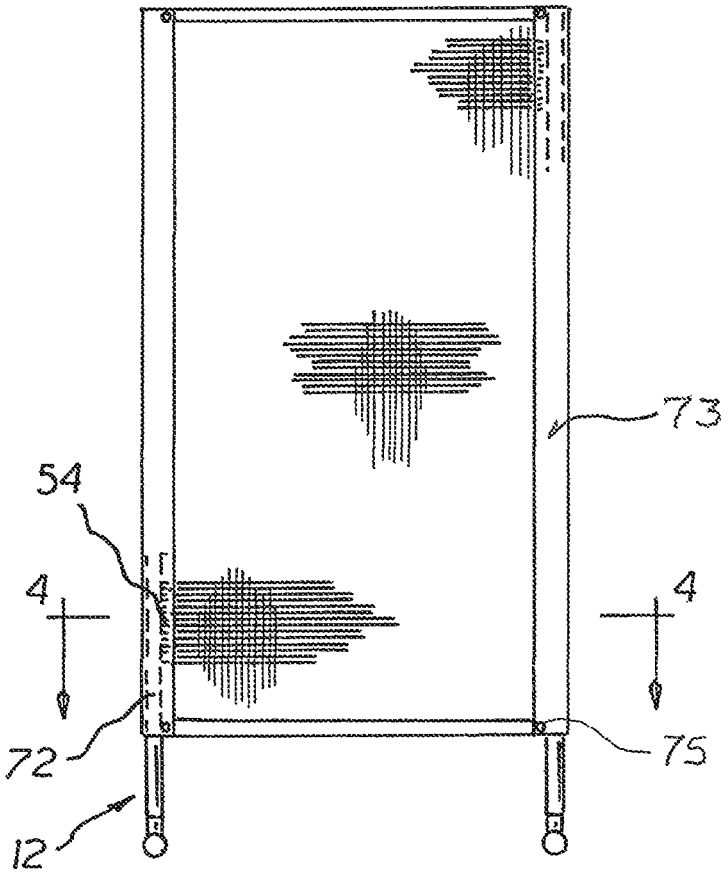
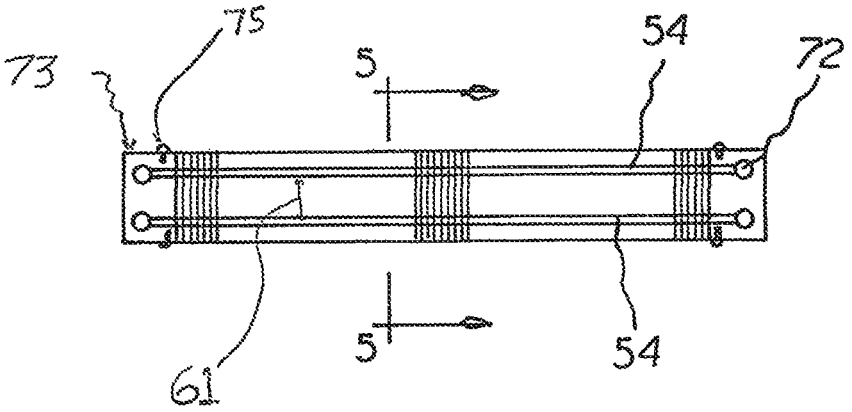
FIG. 4

FIG. 5
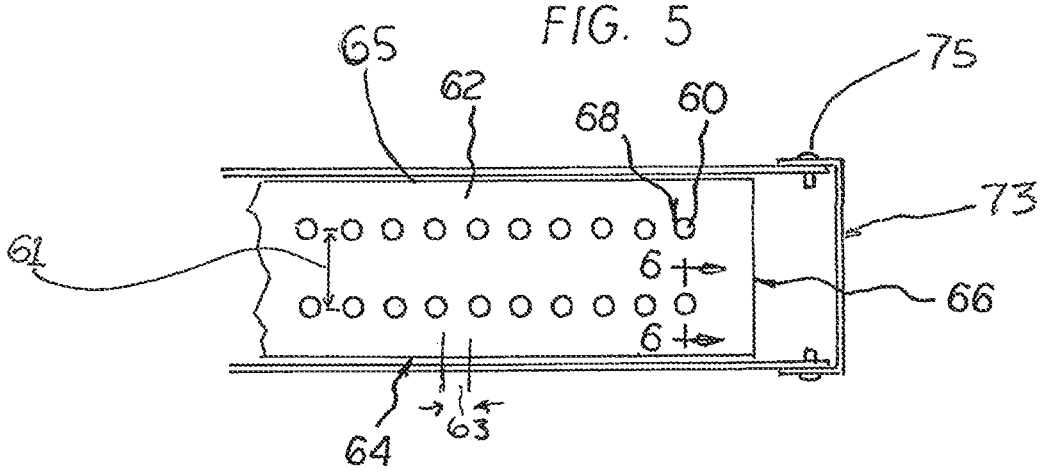
FIG. 6
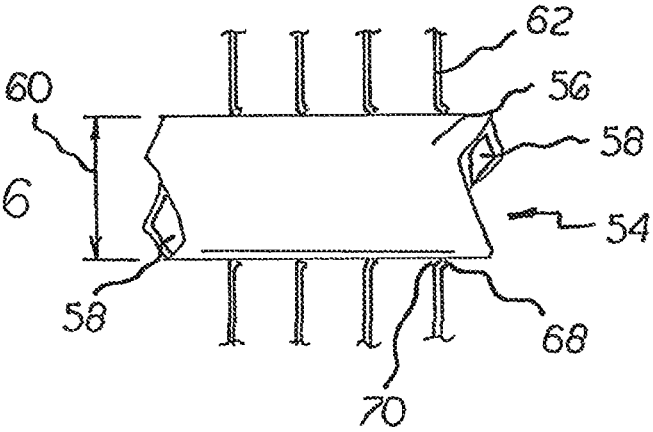
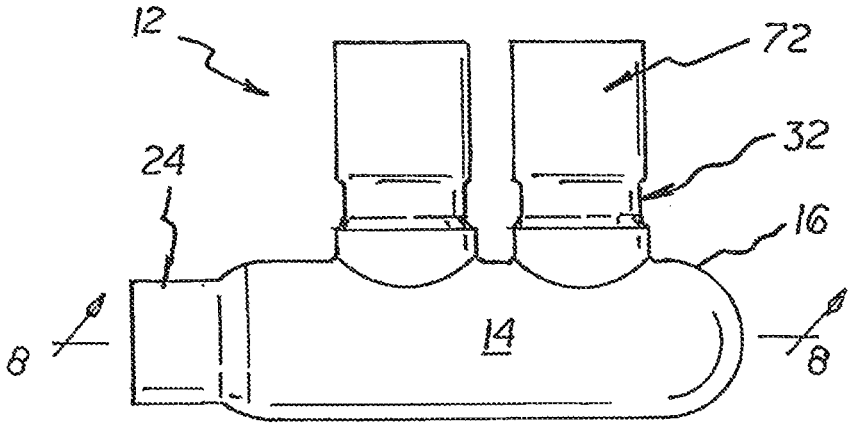
FIG. 7

FIG. 13
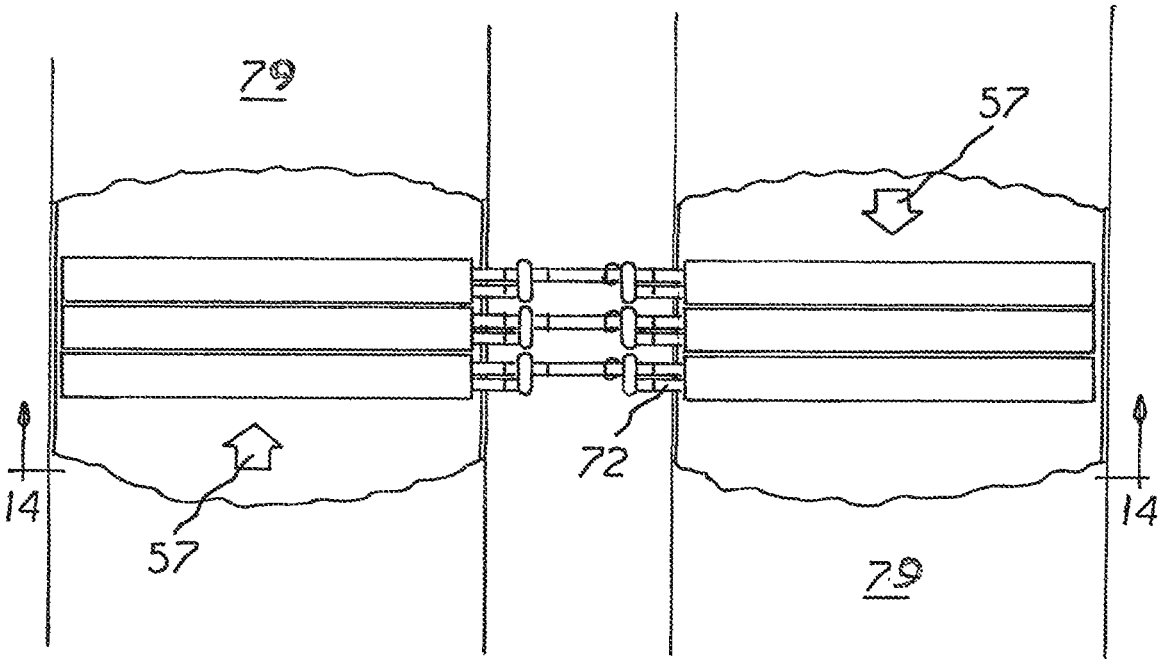
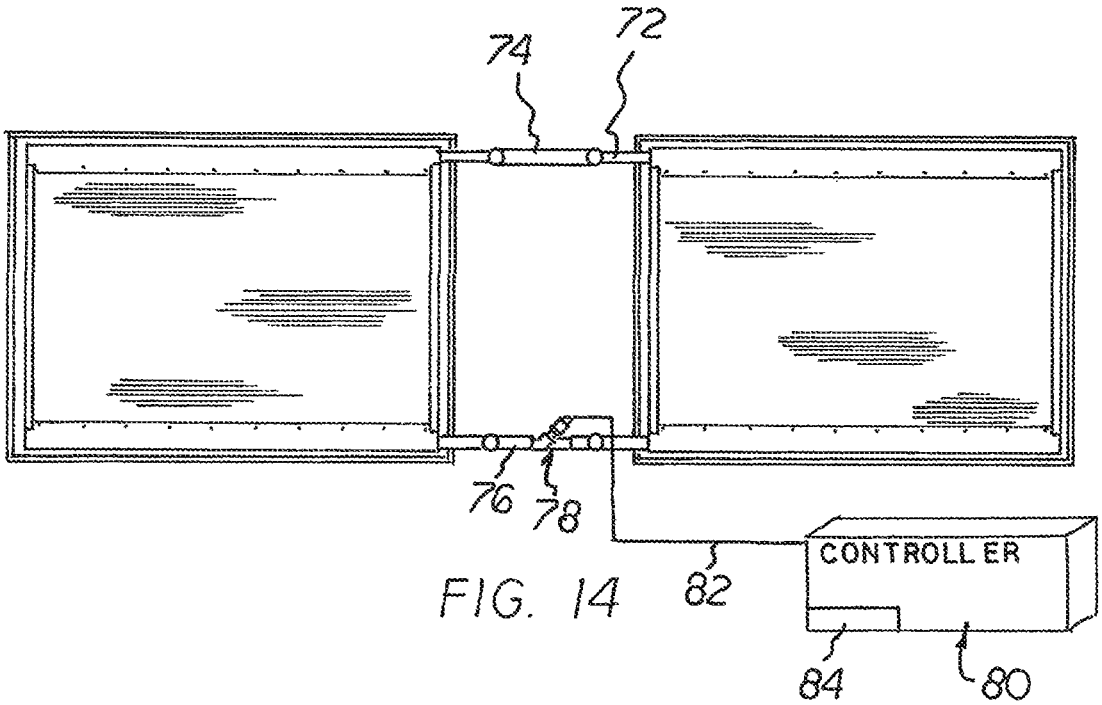
FIG. 14

LOOP HEAT PIPE TRANSFER SYSTEM WITH MANIFOLD

BACKGROUND OF THE INVENTION

Rule 1.78(F)(1) Disclosure

The Applicants have not submitted a related pending or patented non-provisional application within two months of the filing date of this present application. All inventors are named and identified in this application. This application is not under assignment to any other person or entity at this time.

There are no cross referenced or related applications which are direct to, or related to, the present application.

There is no research of development of this application which is federally sponsored.

Field of the Invention

The present invention relates to a LOOP HEAT PIPE TRANSFER SYSTEM WITH MAINFOLD, which is also referred to as a Heat Pipe Transfer System and more particularly pertains to the recovery and re-use of heat in an air conditioning system.

Description of the Prior Art

The use of heat pipes to conserve heat is known in the prior art. More specifically, heat pipes to conserve heat previously devised and utilized for the purpose of the conservation of heat are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe Heat Pipe Transfer System that allows the recovery and re-use of heat in an airconditioning system as is herein described.

In this respect, the Heat Pipe Transfer System, according to the present invention, substantially departs from the conventional concepts and designs of the prior art, and in doing so provides an apparatus primarily developed for the purpose of the recovery and re-use of heat in an airconditioning system.

Therefore, it can be appreciated that there exists a continuing need for a new and improved Heat Pipe Transfer System which can be used for the recovery and re-use of heat in an airconditioning system. In this regard, the present invention substantially fulfills this need.

SUMMARY OF THE INVENTION

In view of the foregoing disadvantages inherent in the known types of heat pipes to conserve heat now present in the prior art, the present invention provides an improved Heat Pipe Transfer System. As such, the general purpose of the present invention, which will be described subsequently in greater detail, is to provide a new and improved Heat Pipe Transfer System which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

In describing aspects of the invention, the word "generally" may be used. The term, "generally" when used to describe a configuration means that the configuration includes those aspects which are within normal manufacturing parameters of acceptance. By way of example, the term "generally round" may be used. This should be interpreted to mean that the configuration may be perfectly round, but may also have a radius which is not exact, but is within the manufacturing parameters. For example, a basketball may be generally round, but not be perfectly round.

By adjacent to a structure is meant that the location is near the identified structure.

To attain this, the present invention essentially comprises a heat pipe transfer system is herein described, the heat pipe transfer system comprising several components, in combination.

There is at least one manifold. The at least one manifold has a generally hollow tubular configuration which forms a tube body. The tube body has an external wall. The tube body external wall of has a thickness of 0.0625 inch plus or minus ten percent.

The at least one manifold hollow tube body has an internal diameter of 2.000 inches plus or minus ten percent. The at least one manifold tube body has at least one rounded closed end.

The at least one manifold tube body has an outlet with a wall having a thickness.

The outlet wall of the at least one manifold forms an outlet tube. The outlet tube of the at least one manifold has an internal diameter. The internal diameter of the outlet tube of the at least one mainfold is 1.625 inches plus or minus ten percent. The outlet tube of the at least one manifold forms an outflow passageway.

The at least one mainfold hollow tubular configuration has at least one inlet opening. Each of the at least one inlet openings has an associated inlet tube. Each inlet tube has a wall thickness. Each inlet tube has an internal diameter of 1.625 inches plus or minus ten percent.

The outlet tube and the at least one inlet tube of the manifold each has the same internal diameter.

The at least one mainfold tube body internal diameter and the at least one mainfold inlet tube internal diameter and the at least one manifold outlet tube internal diameter have a ratio of 1 to 0.8125 to 0.8125. The outlet tube internal diameter and the inlet tube internal diameter, in this configuration, are the same.

In another embodiment there is a manifold having a generally hollow tubular configuration forming a tube body. The tube body has an external wall having a thickness of 0.0625 inch plus or minus ten percent. The manifold hollow tube body has a first internal diameter of 2.400 inches plus or minus ten percent.

The manifold tube body has at least one rounded closed end. In the preferred embodiment, the closed end is in the form of a dome, but in other embodiments the closed end may be an end cap as is well known in the art.

The manifold tube body has an outlet with a wall. The wall has a thickness. The outlet wall of the manifold fors an outlet tube. The outlet tube of the manifold has an internal diameter, with the outlet tube internal diameter of the mainfold being 2.125 inches plus or minus ten percent. The mainfold hollow tubular configuration has at least one inlet opening. Each inlet opening has an associated inlet tube.

Each inlet tube has a wall thicknes. Each inlet tube has an internal diameter of 1.625 inches plus or minus ten percent. The mainfold first tube body internal diameter and the mainfold inlet tube internal diameter and the manifold outlet tube internal diameter having a ratio of 1.000 to 0.8854 to 0.6771.

In another embodiment, the manifold has a generally hollow tubular configuration. The hollow configuration forms a tube body, with the tube body having an external wall. The external wall of the tube body has a thickness of 0.0625 inch plus or minus ten percent. The manifold hollow tube body has an internal diameter of 2.000 inches plus or minus ten percent. The manifold tube body has at least one rounded closed end.

The manifold tube body has an outlet with a wall, with the outlet wall having a thickness. The outlet wall of the manifold forms an outlet tube. The outlet tube of the manifold has an internal diameter, with the internal diameter of the outlet tube of the mainfold being 2.125 inches plus or minus ten percent.

The mainfold hollow tubular configuration has at least one inlet opening. The inlet openings each having an associated inlet tube. Each inlet tube has a wall thickness and each inlet tube having an internal diameter of 1.625 inches plus or minus ten percent. The mainfold tube body first internal diameter and the mainfold inlet tube internal diameter and the manifold outlet tube internal diameter have a ratio of 1.000 to 1.063 to 0.813.

The heat pipe transfer system also comprises a pair of heat transfer units. The heat transfer units being an evaporating unit and a condensing unit. Each of the heat transfer units has a plurality of manifolds operatively coupled to each heat transfer unit.

Each heat transfer unit has a plurality of heat conductive pipes. Each of the heat conductive pipes has a wall with an external surface. Each of the heat conductive pipes has an internal passageway there through. Each heat conductive pipe has an external diameter of 0.500 inch plus or minus ten percent.

Each heat transfer unit has a plurality of heat transfer fins. Each heat transfer fin has two pairs of opposing edges, with each fin having a fin depth of 3.24 inches plus or minus twenty percent. Each of the heat transfer fins having a fin length, which may be varied for each application, but in the preferred embodiment the fin length is 39.00 inches, plus or minus twenty percent. Each heat transfer fin has plurality of pipe holes there through. The pluratity of pipe holes are aligned in two opposing rows. Each heat transfer fin pipe hole has an internal diameter being less than the external diameter of the heat conductive pipe associated therewith so that as the heat conductive pipe is pressed into the pipe hole of each of the heat transfer fins, there is formed a contact point which holds the heat conductive pipe in tight contact with the heat transfer fin.

The heat conductive pipes are aligned in two opposing rows, through the heat transfer fins with each pipe having at least one pipe being adjacent in each row. Each pipe has a fin width spacing of 0.29 inch from the fin edge and a between row spacing in the range of 1.5 inches to 1.75 inches from the opposing heat conductive pipe which is measured from the external pipe surface to the opposing pipe external surface. Each conductive pipe is spaced along the fin length with a distance of 0.75 inch between the external surfaces of each of the adjacent pipes.

The heat pipe transfer system has the evaporating unit and the condensing unit. The evaporating unit and the condensing unit are located in an air duct, with the air duct having an airflow there through. The airflow being one of the classes of air flows consisting of a feed airflow and an exhaust airflow.

The heat transfer units each are operatively coupled by an evaporate coupling pipe and a condensate coupling pipe. The coupling pipes have a servo driven piston valve which is operatively coupled thereto. The coupling pipe name designates the side of the evaporating or condensing unit from which it carries regrigerant.

The servo driven piston valve has an associated controller. The controller has a program for operating the piston servo driven valve. The servo driven piston valve controls the flow of the refrigerant through the couping pipes and the heat transfer units. The program which operates the piston servo driven valve is configured so that it may be modified and set by an end user, allowing a user to select the specific temperature and/or humidity levels for a space which is served by the heat pipe transfer system.

There is a quantity of refrigerant which is contained with the heat pipe transfer system.

There is, in the preferred embodiment, a dehumidification coil located in line, within the air duct, and the dehumidification coil is located between the evaporating unit and the condensing unit.

In other embodiments the heat pipe transfer system may operate without a dehumidification coil, or, in some applications, the dehumidification coil may be located in only one of the air flows.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Heat Pipe Transfer System which has all of the advantages of the prior art heat pipes to conserve heat and none of the disadvantages.

It is another object of the present invention to provide a new and improved Heat Pipe Transfer System which may be easily and efficiently manufactured and marketed.

It is further object of the present invention to provide a new and improved Heat Pipe Transfer System which is of durable and reliable constructions.

An even further object of the present invention is to provide a new and improved Heat Pipe Transfer System which is susceptible of a low cost of manufacture with regard to both materials and labor, and which accordingly is then susceptible of low prices of sale to the consuming public, thereby making such Heat Pipe Transfer System economically available to the buying public.

Even still another object of the present invention is to provide a Heat Pipe Transfer System for the recovery and re-use of heat in an airconditioning system.

Lastly, it is an object of the present invention to provide a new and improved heat pipe transfer system having at least one manifold having a rounded closed end, an outlet tube, and a plurality of inlet openings.

A heat transfer unit has heat transfer fins, with pipes running through pipe holes in the fins.

The manifolds are coupled to a refrigerant carrying pipe.

The manifold, fins, and conductive pipes form an evaporating unit and a condensing unit, which are located in an air having an airflow there through.

There is a quantity of refrigerant being contained with the heat pipe transfer system.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3-3 of FIG. 2.

FIG. 4 is a view taken along line 4-4 of FIG. 3.

FIG. 5 is a view taken along line 5-5 of FIG. 4.

FIG. 6 is a view taken along line 6-6 of FIG. 5.

FIG. 7 is a side elevational view of a manifold showing the pair of inlet tubes and the single outlet tube which is indicated in circle 7 of FIG. 2.

FIG. 13 is a top plan view of two separate airflow ducts, with a plurality of condensors being located in a single duct, and a plurality of evaporators being located in another single duct. The condensors and the evaporators are operatively coupled by evaporator and condensor coupling pipes. The condensor coupling pipe carries the condensate to the evaporator, and the evaporator coupling pipe carries the evaporate to the condensor.

FIG. 14 is a view taken along line 14-14 of FIG. 13. Note the servo controlled piston valve, which is located at an angle relative to the length of condensor coupling pipe, in which it is installed.

The same reference numerals refer to the same parts throughout the various Figures.

DESCRIPTION OF THE PREFERRED EMBODIMENT

Figure 1:
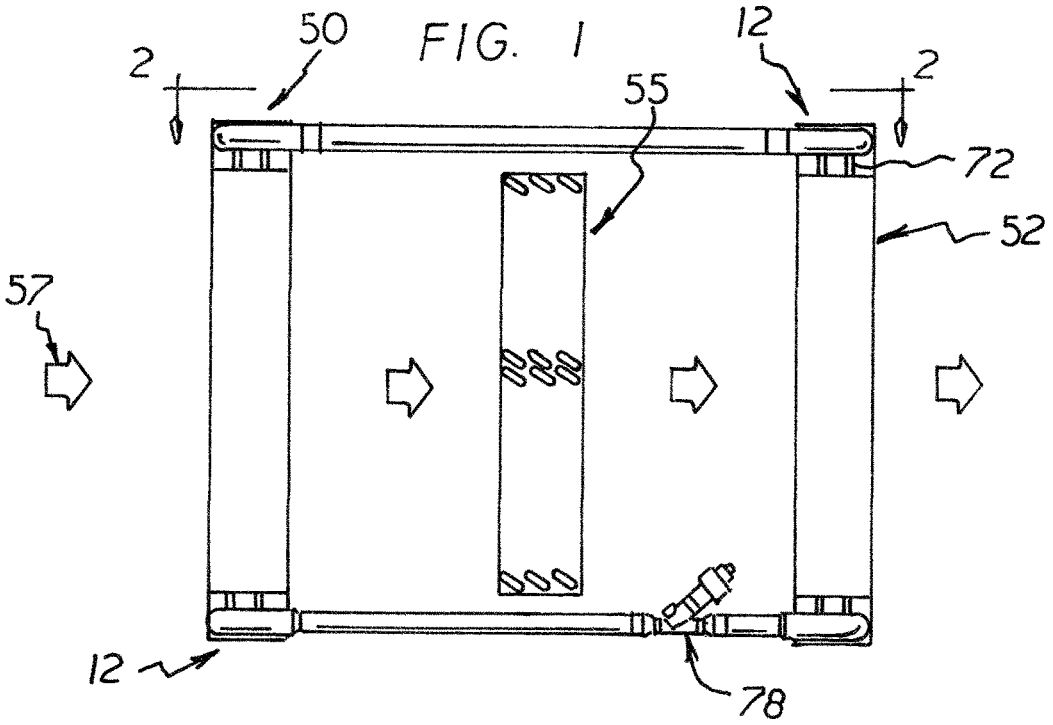
FIG. 1 is a top plan view of an air duct housing an evaporting unit and a condensing unit, and a dehumidification coil.
Figure 2:
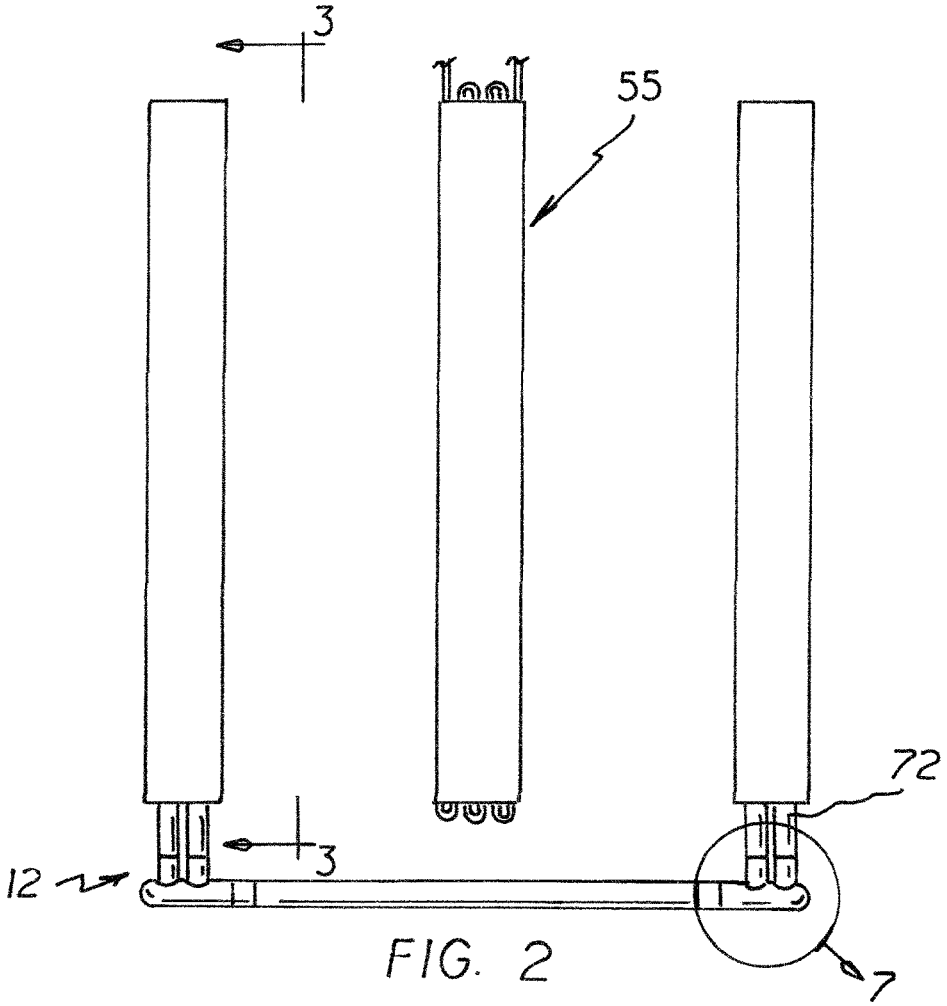
FIG. 2 is a view taken along line 2-2 of FIG. 1.

With reference now to the drawings, and in particular to FIG. 1 thereof, the preferred embodiment of the new and improved Heat Pipe Transfer System embodying the principles and concepts of the present invention and generally designated by the reference numeral 10 will be described.

The present invention, the Heat Pipe Transfer System is comprised of a plurality of components. Such components in their broadest context include an evaporating unit, a condensing unit, a plurality of coupling pipes and a servo driven piston valve. Such components are individually configured and correlated with respect to each other so as to attain the desired objective.

Figure 10:
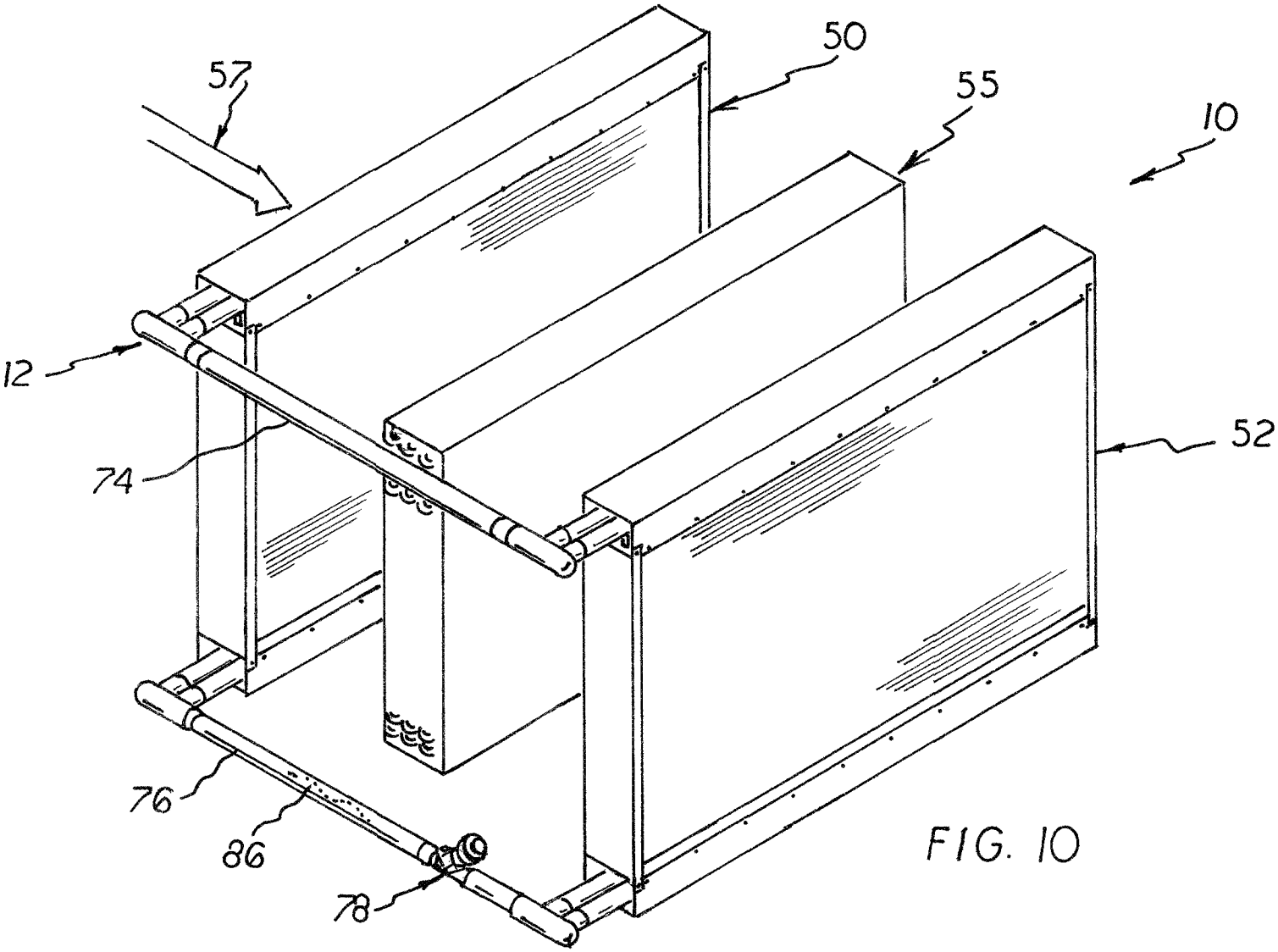
FIG. 10 is a top perspective view of an evaporating unit and a condensing unit, with a dehumidification coil located between the evaporating unit and the condensing unit, as would be found in an air flow passageway, or air duct.
Figure 11:
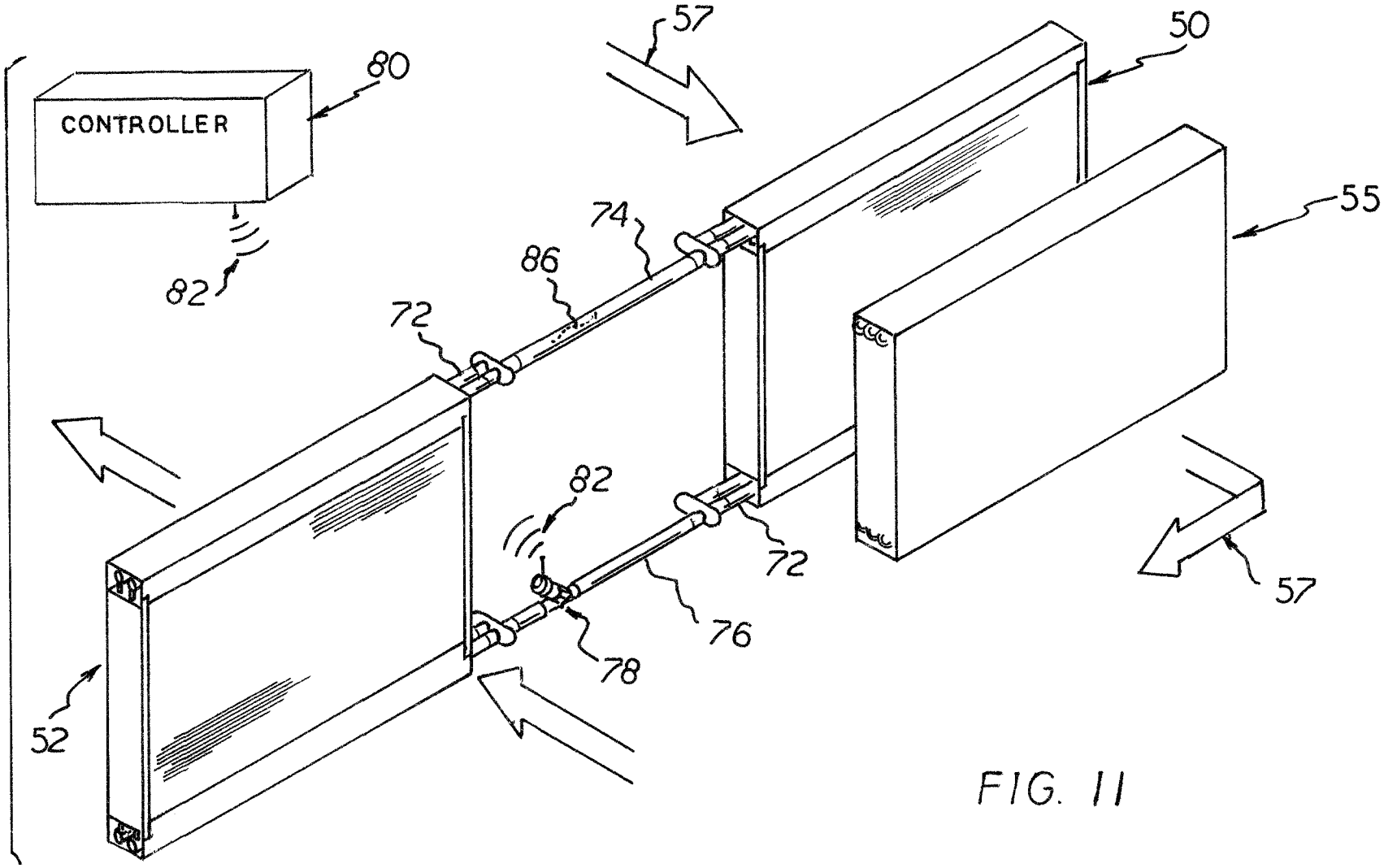
FIG. 11 is a top perspective view of an evaporating unit and a condensing unit, with a dehumidification coil in one airflow path, being the inflow passage, or inflow duct. The evaporating unit is located in a separate, out-going airflow duct.
Figure 12:
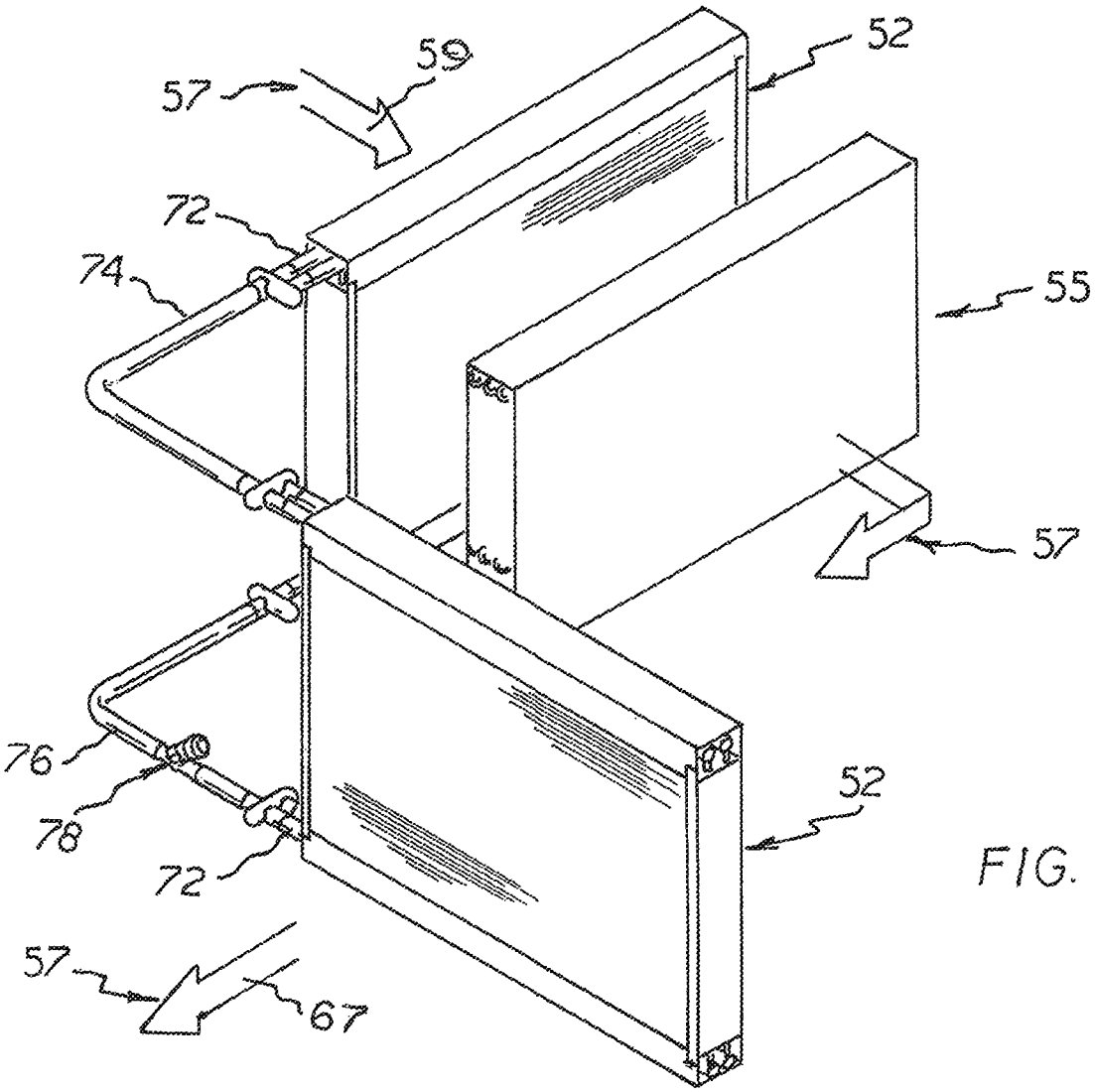
FIG. 12 is a top perspective view of an evaporating unit and a condensing unit, with a dehumidification coil located betweeen the evaporating unit and the condensing unit, as would be found in an air flow passageway, or airduct. In the FIG. 12, the airflow may be channeled through a turn before reaching the evaporating unit, or, in an alternate embodiment, the air ducts, being the inflow duct and the outflow duct, may be located at an angle to each other.

A heat pipe transfer system 10, as shown in FIG. 10, is herein described. The heat pipe transfer system comprises several components, in combination.

Figure 8:
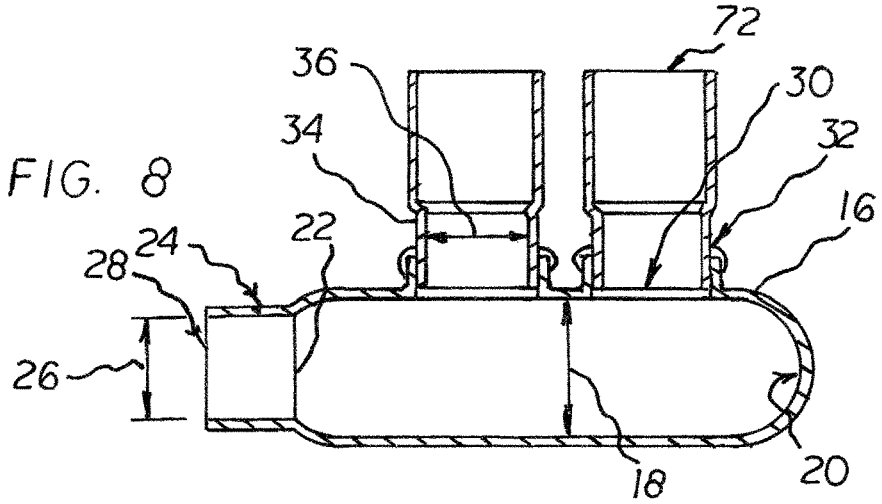
FIG. 8 is a cross sectional view taken along line 8-8 of FIG. 7.

As shown in FIG. 8, there is at least one manifold 12. The at least one manifold has a generally hollow tubular configuration which forms a tube body 14. The tube body has an external wall 16. The tube body external wall of has a thickness of 0.0625 inch plus or minus ten percent.

The at least one manifold hollow tube body has an internal diameter 18 of 2.000 inches plus or minus ten percent. The at least one manifold tube body has at least one rounded closed end 20.

The at least one manifold tube body has an outlet 22 with a wall having a thickness.

The outlet wall of the at least one manifold forms an outlet tube 24. The outlet tube of the at least one manifold has an internal diameter 26. The internal diameter of the outlet tube of the at least one mainfold is 1.625 inches plus or minus ten percent. The outlet tube of the at least one manifold forms an outflow passageway 28.

The at least one mainfold hollow tubular configuration has at least one inlet opening 30. Each of the at least one inlet openings has an associated inlet tube 32. Each inlet tube has a wall thickness 34. Each inlet tube has an internal diameter 36 of 1.625 inches plus or minus ten percent.

In the preferred embodiment, as shown in FIG. 8, the outlet tube and the inlet tube of the manifold each have the same internal diameter. The ratio of outlet tube diameter to the inlet tube diameter is 1:1. In other embodiments, as shown in FIG. 9, the internal diameters of the inlet tubes and the outlet tube are different.

In variations of the embodiment shown in FIG. 8, the mainfold tube body outlet internal diameter and the plurality of inlet tube internal diameters have a ratio of 1, for the outlet tube, to 0.8125 to 0.8125, for the two inlet tubes. The outlet tube internal diameter and the inlet tube internal diameter, in this configuration, are different.

In still another embodiment, as shown in FIG. 9, there is a manifold comprising several components, in combination.

In this embodiment, there is the tube body 14 with an external wall having a thickness of 0.0625 inch plus or minus ten percent. The tube body, shown in FIG. 9A, has a first internal diameter 38 of 2.400 inches plus or minus ten percent.

The manifold tube body has at least one rounded closed end 20. In some variations, the tube body has a pair of oppositely opposed domed ends with an outlet tube being located between the oppositely opposed domed ends. In the embodiments, the closed end is in the form of a dome, as shown in the cross section of FIG. 8, but in other embodiments the closed end may be an end cap (not shown but well known in the art).

The manifold tube body has an outlet with a wall. The wall has a thickness. The outlet wall of the manifold outlet tube 22 has a second internal diameter, with the second internal diameter 40 of the outlet tube of the at least one mainfold being 2.125 inches plus or minus ten percent. The mainfold hollow tubular configuration has at least one inlet opening 30. Each inlet opening has an associated inlet tube 32. Each inlet tube has a wall thicknes. Each inlet tube has an internal diameter 42 of 1.625 inches plus or minus ten percent. The mainfold first tube body internal diameter and the mainfold inlet tube internal diameter and the manifold outlet tube internal diameter having a ratio of 1.000 to 0.8854 to 0.6771.

Figure 9A:
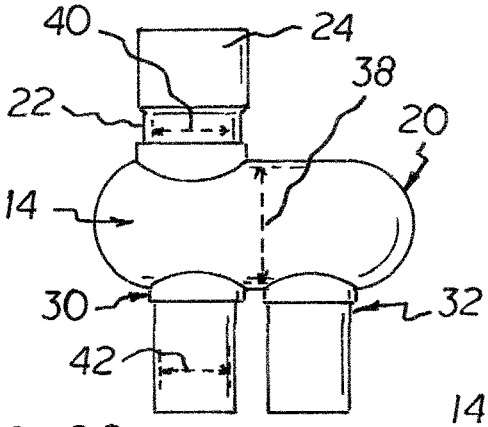
FIG. 9A is a side elevational view of an alternate embodiment, or configuration, of the invention, showing a tube body having an internal diameter of 2.400 inches, plus or minus ten percent.
Figure 9B:
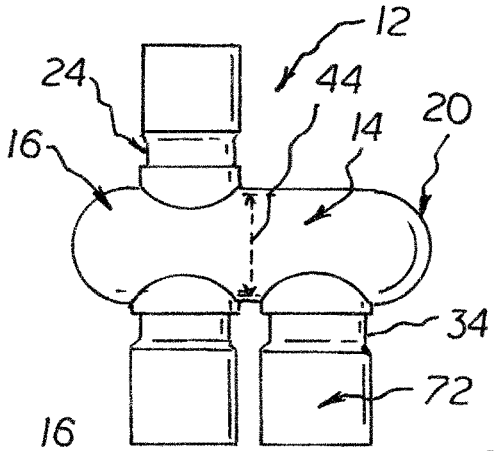
FIG. 9B is a side elevational view of another alternate embodiment, or configuration, of the invention, showing a tube body having an internal diameter of 2.090 inches, plus or minus ten percent.

In still another embodiment, shown in FIG. 9B, the manifold comprises the hollow tube body 14, with the tube body having an external wall 16. The external wall of the tube body has a thickness of 0.0625 inch plus or minus ten percent. The manifold hollow tube body has a first internal diameter 44 of 2.000 inches plus or minus ten percent. The hollow tube body has an external diameter being 2.125 inches plus or minus ten percent. The manifold tube body has at least one rounded closed end 20.

The manifold tube body has an outlet with a wall, with the outlet wall having a thickness. The outlet wall of the manifold forms an outlet tube 24. The outlet tube of the manifold has an internal diameter, with the internal diameter 1.625 inches, plus or minus ten percent.

The mainfold hollow tube body has at least one inlet opening 32. With the inlet openings each having an associated inlet tube 34. Each inlet tube has a wall thickness and each inlet tube having an internal diameter of 1.625 inches plus or minus ten percent. The mainfold tube body first internal diameter and the mainfold inlet tube internal diameter and the manifold outlet tube internal diameter have a ratio of 1.000 to 1.063 to 0.813.

The heat pipe transfer system also comprises a pair of heat transfer units, as shown in FIG. 10. The heat transfer units being an evaporating unit 50 and a condensing unit 52. The heat evaporating unit 50 and the condensing unit 52 each have a plurality of rows of vertical tubes 54, that are separated with a space 61. The space between the rows of vertical tubes is 2.40 inches distance plus or minus ten percent, center of vertical pipe to center of vertical pipe. This give a space of two inches, plus or minus ten percent, between the rows of vertical tubes. The space between the vertical tubes is such that there is about fifty percent more heat transfer fin surface area, between the vertical tubes, than is found in the prior art. This increased placement distance between the vertical tubes has two advantages in that it allows for more surface area for heat exchange via the plurality of heat transfer fins, making the system more efficient, and it allows more distance between vertical tubes which makes the brazing, of the vertical tubes to the collector pipes 72, easier to attain, thereby making manufacture, of the evaporating unit and the condensing unit, a simpler task.

Each of the heat transfer units has a plurality of the manifolds 12 operatively coupled to each heat transfer unit. The manifolds act to transfer vapor or return condensed liquid, from the vertical tubes 54, back to the manifolds. The location of the evaporating unit and the condensing unit varies and is dependent on the overall function, being whether the incoming air is being warmed or cooled as it enters a space through a duct. When used to cool the air, the heat pipe transfer system may be used in conjunction with a dehumidification unit 55. Airflow in a direction is shown as an arrow 57.

Each heat transfer unit has the plurality of the collector pipes 72, and the plurality of the heat conductive pipes 54, as shown in FIG. 4. The plurality of heat conductive pipes of the evaporating unit and the condensing unit being separate from each other and operatively coupled to the collector pipes of the condensing unit and the evaporating unit. The collector pipes carry refrigerant from the manifolds to the heat conductive pipes. Each of the heat conductive pipes has a wall with an external surface 56. Each of the heat conductive pipes has an internal refrigerant passageway 58 there through, as shown in FIGS. 3 and 4. Each heat conductive pipe has an external diameter 60 of 0.500 inch plus or minus ten percent. Each manifold has a plurality of collector pipes coupled thereto. The collector pipes have an internal diameter. The ratio of the collector pipe internal diameter to the distance between the rows of pipes on the heat transfer fins being between 0.70:1 to 1:1.

Each heat transfer unit has the plurality of the heat transfer fins 62. Each heat transfer fin has two pairs of generally parallel opposing edges, one pair being identified as 64 and 65, with the other pair being 66 and it's parallel mated edge, which is not shown in the drawing, FIG. 5, but is well known in the art. Edges 64 and 65 are orthogonal to edge 66. Each heat transfer fin has a fin width of 3.24 inches plus or minus twenty percent. Each of the heat transfer fins has a fin length, which may be varied for each application, but in the preferred embodiment the heat transfer fin length is 39.00 inches, plus or minus twenty percent.

Each heat transfer fin has plurality of pipe holes 68 there through. The pluratity of pipe holes are aligned in two opposing rows, separated as described above. Each heat transfer fin pipe hole has an internal diameter being less than the external diameter of the heat conductive pipe associated therewith so that as the heat conductive pipe is pressed into the pipe hole of each of the heat transfer fins, there is formed a contact point 70 which holds the heat conductive pipe in tight contact with the heat transfer fin allowing for the transfer of heat between the pipe and the fin.

The heat conductive pipes are aligned in two opposing rows, through the heat transfer fins with each pipe having at least one pipe being adjacent in each row. Each pipe has a fin width spacing of 0.29 inch from the fin edge and 1.66 inches from the opposing heat conductive pipe, which is measured from external pipe surface to opposing pipe external surface. Each conductive pipe is spaced along the fin length with a distance 63 of 0.75 inch between the external surfaces of each of the adjacent pipes.

Figure 9C:
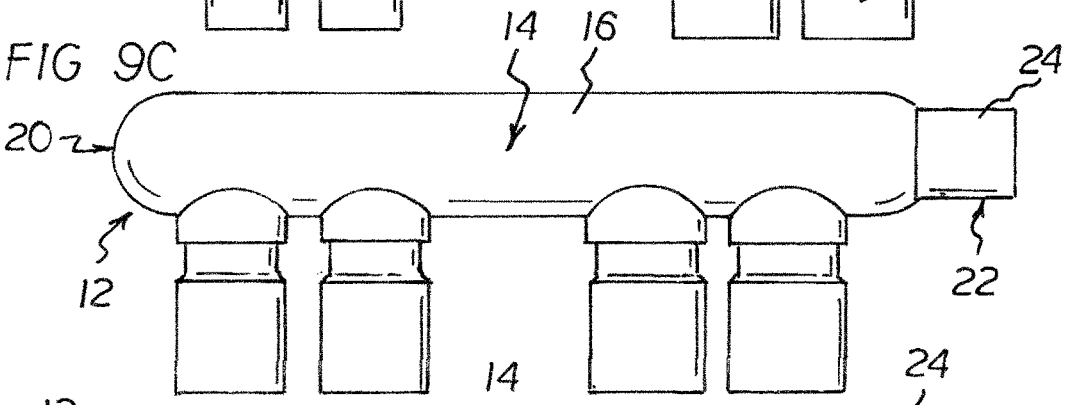
FIG. 9C is a side elevational view of an alternate embodiment or configuration, of the invention, showing a tube body having more than two inlet tubes coupled to collector pipes.
Figure 9D:
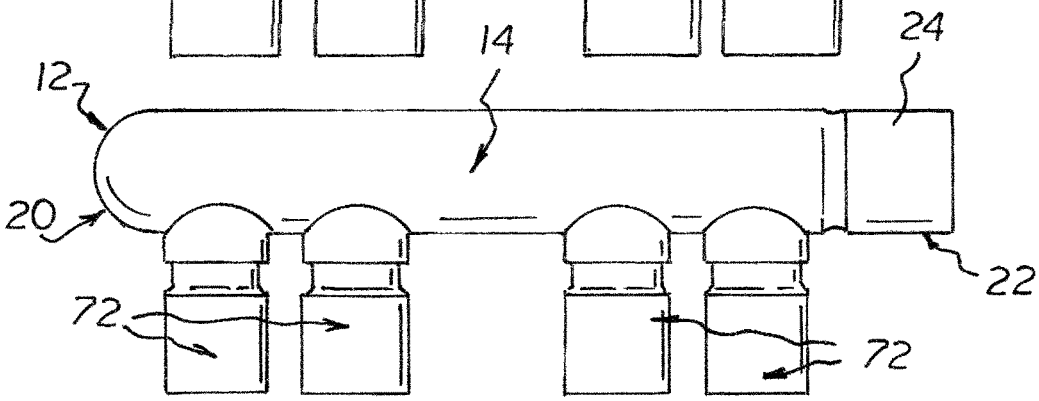
FIG. 9D is another side elevational view of an alternate embodiment, or configuration, of the invention, showing more than two collector pipes being coupled to a manifold tube.

The collector pipe 72 is operatively coupled to each of the inlet tubes of the manifold. As shown in FIG. 9C and FIG. 9D, there may be more than two (2) inlet pipes coupoled to a manifold tube body, with more than two (2) collector pipes coupled to the more than two inlet pipes, of the tube body.

The end covers 73 of the evaporating unit and the condensing unit are a stainless steel (304*ss*) material which provides protection of the collector pipes and conductive pipes. The stainless steel end covers are removably fastened to the evaporating and condensing units by way of an attachment means 75, which consists of the attachments by way of snaps, clips, screws, bolts, tongue/groove arrangements, belts, and clamps.

The configuration of the end covers makes the flashing, of the evaporating and condensing units with an air handler duct, easier to attain.

The heat pipe transfer system evaporating unit and condensing unit are located in an air duct 79, with the air duct having airflow 57 there through. The airflow being one of the classes of air flows consisting of a feed airflow 59 and an exhaust airflow 67.

The heat transfer units each are operatively coupled by an evaporate coupling pipe 74 and a condensate coupling pipe 76. The coupling pipes have a servo driven piston valve 78 which is operatively coupled thereto. The coupling pipe name designates the side of the evaporating or condensing unit from which it carries regrigerant.

The servo driven piston valve has an associated controller 80. The servo is wired 82 to the controller in a method well known in the prior art. The servo may be controlled via a wi-fi network 82, as may be done with thermostats in a building. No further detail of the wi-fi network is herein discussed, as it is well known in the art.

The controller has a program 84 for operating the piston servo driven valve. The servo driven piston valve controls the flow of the refrigerant through the couping pipes and the heat transfer units. The program, which operates the piston servo driven valve, is configured so that it may be modified and set by an end user, allowing a user to select the specific temperature and/or humidity levels for a space which is served by the heat pipe transfer system.

There is a quantity of refrigerant 86 which is contained with the heat pipe transfer system.

There is, in the preferred embodiment, the dehumidification unit 55, comprising a coil and fins, which is located in line within the air duct, and the dehumidification unit is located between the evaporating unit 50 and the condensing unit 52.

In other embodiments the heat pipe transfer system may operate without a dehumidification unit, or, in some applications, the dehumidification coil may be located in only one of the air flows.

Figure 16:
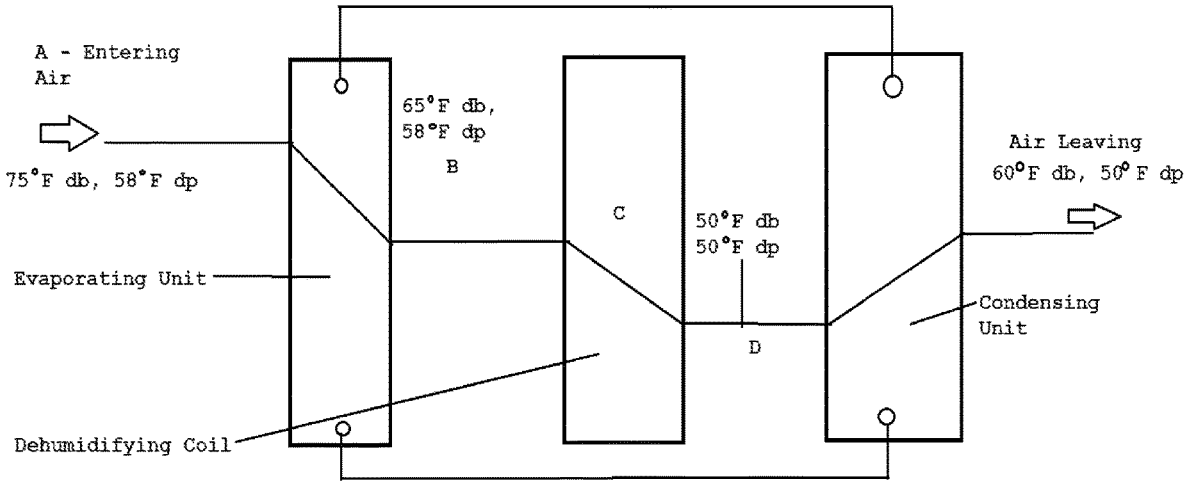
FIG. 16 is a schematic showing air flow moving through the herein described system. The air tempertures, showing the dry bulb (db) temperature and dew point (dp) temperature are shown at various locations within the system.

In FIG. 16, a system is shown, using an evaporating unit 50, a condensing unit 52 and a dehumidification unit 55. Proceeding with the air flow entering the system, at point A, the dry bulb temperature 9 (the db), that is the temperature of the air measured with a thermometer, is 75 degrees Fahrenheit. The dew point, or dp, is the temperature wherein moisture condenses from the air. When the system is functioning, the evaporator, containing refrigerant, absorbes heat from the air, thereby warming the fins of the evaporating unit, causing the refrigerant inside of the evaporating unit to warm and vaporize. The expansion of the refrigerant causes movement within the system, being the evaporating unit and condensing unit, which are operatively coupled by the evaporate coupling pipe 74 and the condensate coupling pipe 76.

As the evaporating unit fins absorb heat from the air, the air temperature (db) decreases to 65 degrees Fahrenheit (point B). The air then moves through the dehumidification unit (point C) which then decreases the temperature to 50 degrees (db) Fahrenheit with a dew point (dp) of 50 degrees Fahrenheit, where it exists the dehumidification unit, at point D. At this point the air is too cold for a living space. The air then moves through the condensing unit 52, wherein the heat received from the refrigerant from the evaporating unit, is then transfered to the air, raising the air temperature to 60 degrees Fahrenheit (db), with the humidity remaining at 50 degrees Fahrenheit (dp). As the refrigerant transfers heat to the air, via the condensing unit fins, the refrigerant temperature decreases and the refrigerant condenses, leaving the condensing unit as a refrigerant liquid, as it is moved through the coupling pipe back to the evaporating unit.

Figure 15:
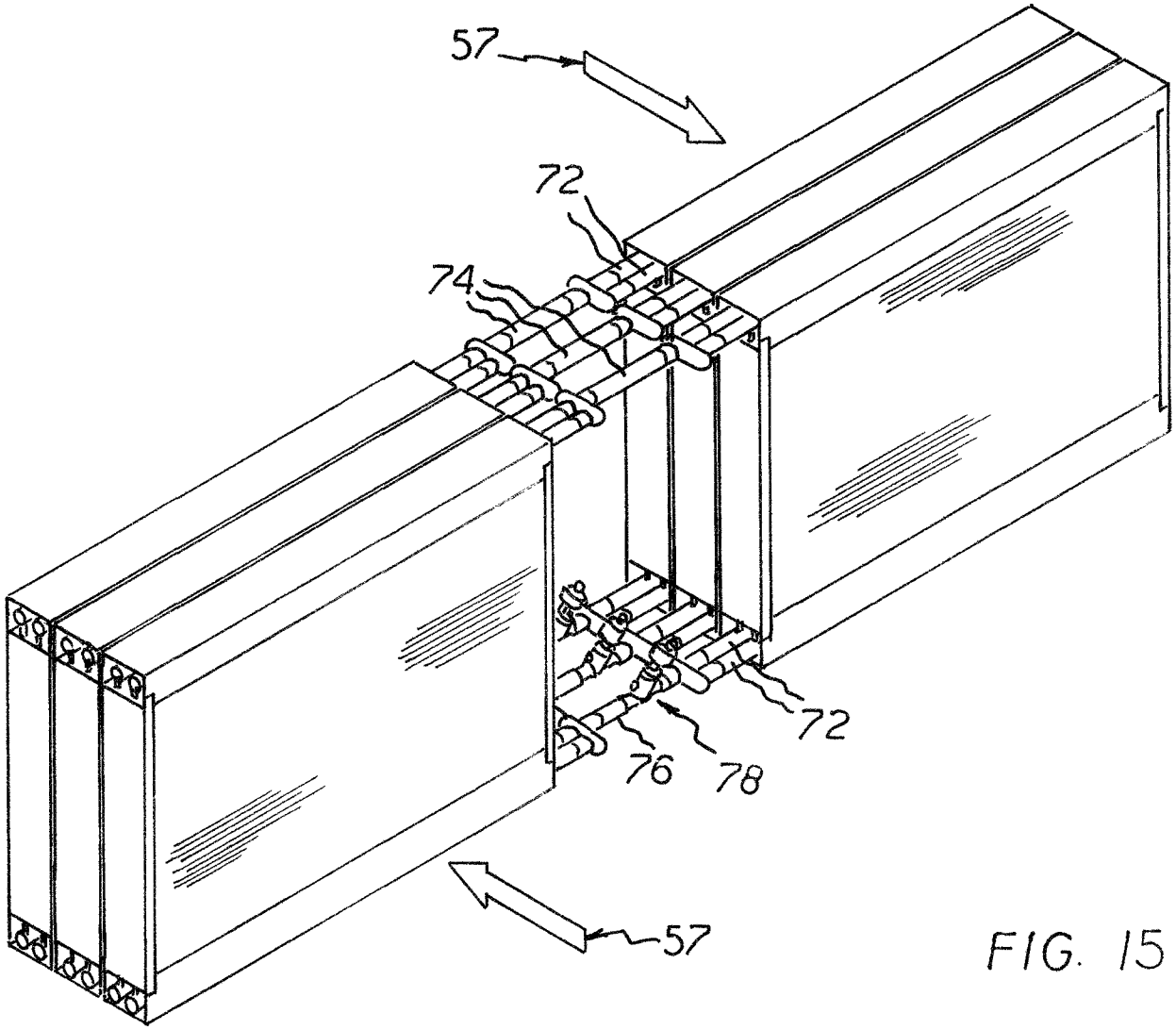
FIG. 15 is a top perspective view of a plurality of condensors which would be configured to be located in a single duct, and a plurality of evaporators which would be configured to be located in another single duct. The condensors and the evaporators are operatively coupled by evaporator and condensor coupling pipes. The condensor coupling pipe carries the condensate to the evaporator, and the evaporator coupling pipe carries the evaporate to the condensor. Note the servo controlled piston valve, which is located at an angle relative to the length of condensor coupling pipe, in which it is installed.

In an alternate embodiment, the heat transfer system may be used without a dehumidification unit. In this embodiment, as shown in FIGS. 13, 14, and 15, the air moves through two separate ducts. Usually, there is a usable (living) space between the two ducts, such as a room, office, or storage space. The air moves from the outside, to the room or office, and then the air moves through a duct to the outside of the building. In this use, the air moves from the outside of a building through a duct, to, and through, the condensing unit. This embodiment is directed to heat preservation in a building, so that the evaporating and condensing unit locations within the system are reversed.

In the heat conserving configuration, the condensing unit gives up heat contained within the evaporated refrigerant, condensing the refrigerant, and passing the air through in a warmer state. The air then moves into a living space, such as an office, and that air warms the space. The air is then exhausted to the outside of the building, via a duct, which contains the evaporating unit. The refrigerant, which is condensed to a liquid state, moves through the evaporating unit. As it does so, it removes heat from the exhaust air, cooling that air before sending it outside of the building. That heat is then stored as an evaporated refrigerant, and it moves along the system, back to the condensing unit, completing the cycle of heat transfer.

Coupling of the pipes so as to form a gas tight seal is achieved by a product referred to as Silvaloy 5 ® which is made by Smillie McAdams Summerlin Ltd, of 1650 McEwen Drive, Whitby, Ontario, LIN 0A1, Canada. Silvaloy 5 ® has good flow and wetting properties on copper, brass, and bronze. Its melting characteristics are such that on the low end of its brazing temperature range it has a "sluggish" flow characteristic which enables it to fill gaps better, making it ideal for loose-fitting joints. On the other hand, when brazing at the high end of its brazing temperature range, it is very fluid, making it ideal for tight-fitting joints requiring deep penetration. The phosphorous content of Silvaloy 5 ® acts as a fluxing agent and no flux is necessary when brazing copper-to-copper joints. However, when used with one of the other brazeable metals, a brazing flux must be used to promote wetting, bonding, and flow through the joint. The flow point of Silvaloy 5 ® is 1325° F. (718° C.).

The composition of Silvaloy is: Silver 5.00 wt %; Phosphorous 6.00 wt %; Copper 89 wt %, and total other elements 0.15 wt %, maximum.

Silvaloy 5 ® is the bonding agent of choice in that it produces a flowable brazing agent which provides deep contact between the brazed objects. There is some flexibility so that the joints are better configured to withstand stresses encountered during and after installation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A heat pipe transfer system, comprising, in combination:

at least one manifold with the at least one manifold having a generally hollow tubular configuration forming a tube body with the tube body having an external wall, with the external wall of the tube body having a thickness, the at least one manifold tube body having at least one rounded closed end, the at least one manifold tube body having an outlet with a wall having a thickness, the outlet wall of the at least one manifold forming an outlet tube, the outlet tube of the at least one manifold forming an outflow passageway, the at least one manifold hollow tubular configuration having at least one inlet opening, with each of the at least one inlet openings having associated inlet tube, each inlet tube having a wall thickness and each inlet tube having an internal diameter;

an evaporating unit and a condensing unit, referred to as a pair of heat transfer units, with the evaporating unit and the condensing unit each having a having a plurality of heat conductive pipes, the plurality of heat conductive pipes of the evaporating unit and the condensing unit being separate from each other and operatively coupled to a collector pipe of the condensing unit and the evaporating unit, each of the heat conductive pipes having a wall with an external surface and each of the heat conductive pipes having an internal passageway there through, with each heat conductive pipe having an external diameter of 0.500 inch plus or minus ten percent;

each manifold having a plurality of collector pipes coupled thereto;

the evaporating unit and condensing unit each having a plurality of heat transfer fins, with each of the heat transfer fins having two pairs of opposing edges, with each of the heat transfer fins having a fin width of 3.24 inches plus or minus twenty percent, and each of the heat transfer fins each having a fin length, each heat transfer fin having plurality of pipe holes there through, with the plurality of pipe holes being aligned in two opposing rows, with each heat transfer fin pipe hole having an internal diameter being less than the external diameter of the heat conductive pipe associated therewith so that as the heat conductive pipe is pressed into the pipe hole of each of the heat transfer fins, wherein there is formed a contact point which holds the heat conductive pipe in tight contact with the heat transfer fin, the heat conductive pipes being aligned in two opposing rows through the heat transfer fins with each pipe having at least one pipe being adjacent in each row, with each pipe having a fin width spacing of 0.29 inch from the fin edge and having a between row spacing in the range of 1.50 inches to 1.75 inches from the opposing heat conductive pipe which is measured from external pipe surface to opposing external pipe surface, with each conductive pipe being spaced along the fin length having a distance of 0.75 inch between each of the external surface of the adjacent pipes;

the evaporating unit and the condensing unit each having a plurality of the manifolds operatively coupled thereto, each of the manifolds being coupled to a refrigerant carrying pipe, each of the refrigerant carrying pipes having a wall with an external surface and each of the refrigerant carrying pipes having an internal passageway there through;

the heat pipe transfer system having the evaporating unit and the condensing unit being located in an air duct with the air duct having an airflow there through, the airflow being one of the classification of air flows comprising of a feed airflow and an exhaust airflow; and a quantity of refrigerant being contained with the heat pipe transfer system.

2. The heat pipe transfer system as described in claim 1, with the system further comprising:

the tube body external wall thickness being 0.0625 inch plus or minus ten percent;

the at least one manifold hollow tube body having a first internal diameter of 2.000 inches plus or minus ten percent;

the outlet tube of the at least one manifold having an internal diameter of 1.625 inches plus or minus ten percent;

the inlet tube having an internal diameter of 1.625 inches plus or minus ten percent; and the outlet tube and the at least one inlet tube of the manifold each having the same internal diameter, the at least one manifold first tube body internal diameter and the at least one manifold inlet tube internal diameter and the at least one manifold outlet tube internal diameter having a ratio of 1 to 0.8125 to 0.8125, the outlet tube internal diameter and the inlet tube internal diameter being the same.

3. The heat pipe transfer system as described in claim 2, with the system further comprising:

with each refrigerant carrying pipe having an external diameter of 0.500 inch plus or minus ten percent, the refrigerant carrying pipe being an evaporate coupling pipe and a condensate coupling pipe;

the at least one of the coupling pipes having a servo driven piston valve operatively coupled thereto;

the servo driven piston valve having an associated controller, with the controller having a program for operating the piston servo driven valve, the servo driven piston valve controlling the flow of the refrigerant through the coupling pipes and the heat transfer units; and a dehumidification coil located in line with and between the evaporating unit and the condensing unit.

4. The heat pipe transfer system and described in claim 3, with the system further comprising:

a ratio of conductive pipe internal diameter to the distance between the rows of pipes on the heat transfer fins being between 1:3.5 to 1:4.5; and the collector pipes each having an internal diameter, the collector pipe each being operatively coupled to each conductive pipes and to the inlet tubes of the manifold with a ratio of the collector pipe internal diameter to the distance between the rows of pipes on the heat transfer fins being between 0.70:1 to 1:1.

5. The heat pipe transfer system as described in claim 1, with the system further comprising:

the at least one manifold having an external wall having a thickness of 0.0625 inch plus or minus ten percent;

the at least one manifold hollow tube body having a first internal diameter of 2.400 inches plus or minus ten percent;

the outlet tube of the at least one manifold having an internal diameter of 2.125 inches plus or minus ten percent;

the at least one mainfold hollow inlet tube having an internal diameter of 1.625 inches plus or minus ten percent; and the at least one mainfold tube body internal diameter and the at least one mainfold inlet tube internal diameter and the at least one manifold outlet tube internal diameter having a ratio of 1.000 to 0.8854 to 0.6771.

6. The heat pipe transfer system ad described in claim 5, with the system further comprising:

with each refrigerant carrying pipe having an external diameter of 0.500 inch plus or minus ten percent;

the at least one of the coupling pipes having a servo driven piston valve operatively coupled thereto;

the servo driven piston valve having an associated controller, with the controller having a program for operating the piston servo driven valve, the servo driven piston valve controlling the flow of the refrigerant through the couping pipes and the heat transfer units; and a dehumidification coil located in line with and between the evaporating unit and the condensing unit.

7. The heat pipe transfer system as described in claim 1, with the system further comprising:

the external wall of the at least one manifold tube body having a thickness of 0.0625 inch plus or minus ten percent;

the at least one manifold hollow tube body having an internal diameter of 2.000 inches plus or minus ten percent;

the internal diameter of the outlet tube of the at least one mainfold being 2.125 inches plus or minus ten percent;

each inlet tube having an internal diameter of 1.625 inches plus or minus ten percent; and the at least one mainfold tube body first internal diameter and the at least one mainfold inlet tube internal diameter and the at least one manifold outlet tube internal diameter having a ratio of 1.000 to 1.063 to 0.813.

8. The heat pipe transfer system ad described in claim 7, with the system further comprising:

with each refrigerant carrying pipe having an external diameter of 0.500 inch plus or minus ten percent;

the at least one of the coupling pipes having a servo driven piston valve operatively coupled thereto;

the servo driven piston valve having an associated controller, with the controller having a program for operating the piston servo driven valve, the servo driven piston valve controlling the flow of the refrigerant through the couping pipes and the heat transfer units; and a dehumidification coil located in line with and between the evaporating unit and the condensing unit.

* * * * *